US008639129B2

(12) United States Patent
Kaneko

(10) Patent No.: US 8,639,129 B2
(45) Date of Patent: Jan. 28, 2014

(54) PRINTING SYSTEM AND IMAGE FORMING APPARATUS FOR CONTROLLING A SETTING ACCORDING TO REPLACEMENT OF A CONSUMABLE OF AN IMAGE FORMING APPARATUS

(75) Inventor: Tsuyoshi Kaneko, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 687 days.

(21) Appl. No.: 12/779,799

(22) Filed: May 13, 2010

(65) Prior Publication Data

US 2010/0290793 A1 Nov. 18, 2010

(30) Foreign Application Priority Data

May 15, 2009 (JP) ..... 2009-118975

(51) Int. Cl.
*G03G 15/00* (2006.01)

(52) U.S. Cl.
USPC ..... 399/24; 399/26

(58) Field of Classification Search
USPC ..... 399/23–24, 26
See application file for complete search history.

(56) References Cited

U.S. PATENT DOCUMENTS

| | | | | |
|---|---|---|---|---|
| 4,974,238 | A * | 11/1990 | Kobayashi et al. | 377/16 |
| 6,205,298 | B1 * | 3/2001 | Yamamoto | 399/25 |
| 6,363,226 | B1 * | 3/2002 | Batori | 399/8 |
| 6,606,466 | B2 * | 8/2003 | Sato | 399/82 |
| 6,988,839 | B1 * | 1/2006 | Yu | 400/76 |
| 7,130,559 | B2 * | 10/2006 | Kimura et al. | 399/109 |
| 7,206,752 | B2 * | 4/2007 | Kobayashi | 705/7.12 |
| 7,340,351 | B2 * | 3/2008 | Oyasato et al. | 702/30 |
| 7,782,508 | B2 * | 8/2010 | Kondo | 358/538 |
| 8,081,347 | B2 * | 12/2011 | Tamada et al. | 358/3.28 |
| 8,331,815 | B2 * | 12/2012 | Nishikawa | 399/53 |
| 8,451,496 | B2 * | 5/2013 | Ohashi | 358/1.9 |
| 2002/0095348 | A1 * | 7/2002 | Hiroshige et al. | 705/26 |
| 2004/0080787 | A1 * | 4/2004 | Kakikawa et al. | 358/1.18 |
| 2005/0117918 | A1 * | 6/2005 | Kimura et al. | 399/8 |
| 2006/0224705 | A1 * | 10/2006 | Takase | 709/220 |
| 2007/0226075 | A1 * | 9/2007 | Hiroshige et al. | 705/26 |
| 2007/0236720 | A1 * | 10/2007 | Tamada et al. | 358/1.14 |

(Continued)

FOREIGN PATENT DOCUMENTS

| | | |
|---|---|---|
| JP | 2001-242752 A | 9/2001 |
| JP | 2003-280865 A | 10/2003 |
| JP | 2005-125687 A | 5/2005 |
| JP | 2008-185824 | 8/2008 |

OTHER PUBLICATIONS

English machine translation of Japanese patent document, Sato et al. (JP 2008-185824 A); original document by Sato, Naohito; Shiba, Rikio; Nozawa, Keita; and Tachibana, Shinichi; original document published Aug. 14, 2008.*

(Continued)

*Primary Examiner* — David Gray
*Assistant Examiner* — Geoffrey Evans
(74) *Attorney, Agent, or Firm* — Canon USA Inc. IP Division

(57) ABSTRACT

A printing system includes an instruction unit for instructing, in response to determination of using a reuse consumable in the case of replacement of a consumable of an image forming apparatus, a setting to be changed according to the replacement with the reuse consumable, wherein the setting instructed by the instruction unit is performed in the image forming apparatus after the replacement with the reuse consumable.

6 Claims, 15 Drawing Sheets

(56) References Cited

U.S. PATENT DOCUMENTS

| | | | | |
|---|---|---|---|---|
| 2010/0027051 | A1* | 2/2010 | Hamilton et al. | 358/1.15 |
| 2010/0149580 | A1* | 6/2010 | Iizuka | 358/1.14 |
| 2010/0272449 | A1* | 10/2010 | Yoshida et al. | 399/2 |
| 2011/0032569 | A1* | 2/2011 | Ohashi | 358/1.15 |
| 2011/0079545 | A1* | 4/2011 | Saeki | 209/552 |
| 2012/0308245 | A1* | 12/2012 | Inoue et al. | 399/24 |
| 2012/0325101 | A1* | 12/2012 | Tanaka et al. | 101/483 |
| 2012/0328306 | A1* | 12/2012 | Kaneko | 399/8 |
| 2013/0051819 | A1* | 2/2013 | Aizono | 399/24 |
| 2013/0136462 | A1* | 5/2013 | Iida | 399/23 |
| 2013/0136463 | A1* | 5/2013 | Inoue et al. | 399/24 |

OTHER PUBLICATIONS

English machine translation of Japanese patent document (JP 2005-125687 A); "Method of Forming Image, Image Forming Apparatus and User Terminal"; by O, Kokuto; Miyazawa, Yasushi; Hattori, Teruhiro; published May 19, 2005.*

* cited by examiner

FIG.4

| 401 COMPONENT NAME | 402 SERIAL NUMBER | 403 UNIT | 404 CURRENT COUNTER | 405 CONSUMPTION RATIO (%) | 406 PREVIOUS REPLACEMENT DATE |
|---|---|---|---|---|---|
| Photosensive drum (K) | 1000xxx1 | NUMBER OF SHEETS | 95000 | 95.0 | 2007/8/25 |
| Transfer Cleaner Unit | 5412xxx7 | NUMBER OF SHEETS | 52315 | 43.6 | 2008/2/2 |
| Waste Toner Box | 3562xxx3 | NUMBER OF SHEETS | 6759 | 33.79 | 2007/9/22 |
| ⋮ | ⋮ | ⋮ | ⋮ | ⋮ | ⋮ |

FIG.5

501

| | |
|---|---|
| CUSTOMER NAME | A |
| CUSTOMER ID | Customer01 |
| CONTRACT START DATE | 2006/12/15 |
| CONTRACT TERMINATION DATE | 2009/12/15 |
| REMAINING CONTRACT TERM (DAYS) | 20 |
| REUSE CONTRACT | Yes |
| PERSON IN CHARGE OF DEVICE | TARO KOSUGI |
| AVERAGE NUMBER OF PRINTED SHEETS (SHEETS/DAY) | 10000 |
| ⋮ | ⋮ |

FIG.6

| 601 | 602 | 603 | 604 | 605 | 606 |
|---|---|---|---|---|---|
| COMPONENT NAME | SERIAL NUMBER | UNIT | CURRENT COUNTER | CONSUMPTION RATIO (%) | COLLECTION DATE |
| Photosensive drum (K) | 1000xxx1 | NUMBER OF SHEETS | 85000 | 85.0 | 2008/09/02 |
| Photosensive drum (K) | 1000xxx2 | NUMBER OF SHEETS | 63892 | 63.9 | 2006/11/19 |
| Photosensive drum (K) | 1000xxx3 | NUMBER OF SHEETS | 74632 | 74.6 | 2008/12/22 |
| Waste Toner Box | 8566xxx3 | NUMBER OF SHEETS | 13518 | 67.6 | 2007/1/18 |

FIG.7

701 702

| REUSE COMPONENT NAME | SETTING |
|---|---|
| Photosensive drum | EXECUTE AUTOMATIC CALIBRATION |
| Secondary fixing refresh roller | REDUCE NUMBER OF ROTATIONS OF ROLLER |
| BACK SIDE OF PRINTED PAPER | RESTRICT TWO-SIDED PRINTING |
| ⋮ | ⋮ |

FIG.13A

NOTIFICATION OF COMPONENT REPLACEMENT

CONSUMPTION RATIO OF THE FOLLOWING COMPONENT HAS REACHED THE PRESCRIBED VALUE.
PERFORM REPLACEMENT WITH NEW COMPONENT OR REUSE COMPONENT.

· COMPONENT NAME: Photosensive drum

NEW COMPONENT REPLACEMENT | REUSE COMPONENT REPLACEMENT

FIG.13B

REUSE COMPONENT LIST

SELECT REUSE COMPONENT TO BE REPLACED.

| COMPONENT NAME | SERIAL NUMBER | UNIT | CURRENT COUNTER | CONSUMPTION RATIO (%) | COLLECTION DATE |
|---|---|---|---|---|---|
| Photosensive drum (K) | 1000xxx1 | NUMBER OF SHEETS | 85000 | 85.0 | 2008/09/02 |
| Photosensive drum (K) | 1000xxx2 | NUMBER OF SHEETS | 63892 | 63.9 | 2006/11/19 |
| Photosensive drum (K) | 1000xxx3 | NUMBER OF SHEETS | 74632 | 74.6 | 2008/12/22 |
| Waste Toner Box | 8566xxx3 | NUMBER OF SHEETS | 13518 | 67.6 | 2007/1/18 |

FIG.13C

SETTING CHANGE DUE TO COMPONENT REPLACEMENT

PRINT QUALITY CAN BE IMPROVED BY EXECUTING THE FOLLOWING PROCESSING IN VIEW OF CONSUMPTION RATIO OF REUSE COMPONENT TO BE REPLACED.
DO YOU ALLOW EXECUTING THIS PROCESSING?
· EXECUTION OF AUTOMATIC CALIBRATION (COLOR ADJUSTMENT)

EXECUTE | DO NOT EXECUTE

FIG.14A

NOTIFICATION OF PAPER SUPPLY

NO PAPER IN THE FOLLOWING CASSETTE.
SUPPLY PAPER.
· CASSETTE 2

PLAIN PAPER REPLACEMENT

BACK SIDE OF PRINTED PAPER REPLACEMENT

FIG.14B

SETTING CHANGE DUE TO USE OF BACK SIDE OF PRINTED PAPER

PAPER SUPPLIED TO CASSETTE 2 IS BACK SIDE OF PRINTED PAPER.
DO YOU WANT TO INHIBIT TWO-SIDED PRINTING IN CASE OF FEEDING PAPER FROM CASSETTE 2 FOR PRINTING?

EXECUTE

DO NOT EXECUTE

PRINTING SYSTEM AND IMAGE FORMING APPARATUS FOR CONTROLLING A SETTING ACCORDING TO REPLACEMENT OF A CONSUMABLE OF AN IMAGE FORMING APPARATUS

BACKGROUND OF THE INVENTION

1. Field of the Invention

The present invention relates to a technique for management of consumables of an image forming apparatus.

2. Description of the Related Art

As to consumables of an image forming apparatus, life management of the consumables based on use histories thereof has been known. Also, a management system that performs stock management of reuse consumables to enable replacement with the reuse consumables in the case of consumable replacement has been proposed. In a management system discussed in Japanese Patent Application Laid-Open No. 2008-185824, an image forming apparatus sends a request for replacement of a consumable to a management apparatus when the end of life of the consumable is about to be reached. Then, the management apparatus extracts a reuse consumable which is an object for replacement based on a remaining contract term of the image forming apparatus, a use status by the customer, and remaining life of a managed reuse consumable.

However, in the case of the reuse consumable replacement, it has been necessary to consider various settings (settings for color, printing, etc.) and the like of the image forming apparatus corresponding to a past use status after the replacement, which is different from replacement with a new consumable.

SUMMARY OF THE INVENTION

The present invention is directed to a method that enables inputting appropriate settings in the case of using a reuse component when replacing a consumable such as a component of an image forming apparatus.

According to an aspect of the present invention, there is provided a printing system including a management apparatus for managing replacement according to a consumption degree of a consumable of an image forming apparatus using a new consumable or a reuse consumable, including a determination unit configured to determine which of the new consumable and the reuse consumable to use in a case of replacing the consumable of the image forming apparatus, a notification unit configured to notify that the new consumable or the reuse consumable is to be used for the replacement based on a result of the determination by the determination unit, and an instruction unit configured to instruct a setting to be changed according to the replacement with the reuse consumable if it is determined by the determination unit that the reuse consumable is to be used, wherein the setting instructed by the instruction unit is performed in the image forming apparatus after the replacement with the reuse consumable based on the determination by the determination unit.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

FIG. 4 illustrates an example of an information table of consumables, which is stored in the management apparatus.

FIG. 5 illustrates an example of an information table of customers, which is stored in the management apparatus.

FIG. 6 illustrates an example of an information table of reuse consumables, which is stored in the management apparatus.

FIG. 7 illustrates an example of an association table of reuse components to be replaced and settings of the image forming apparatus to be changed by the replacement.

FIGS. 13A to 13C are diagrams illustrating examples of display screens of replacement components in the image forming apparatus.

FIGS. 14A and 14B are diagrams illustrating examples of display screens of replacement components in the image forming apparatus.

DESCRIPTION OF THE EMBODIMENTS

Various exemplary embodiments, features, and aspects of the invention will be described in detail below with reference to the drawings.

Figure 1:
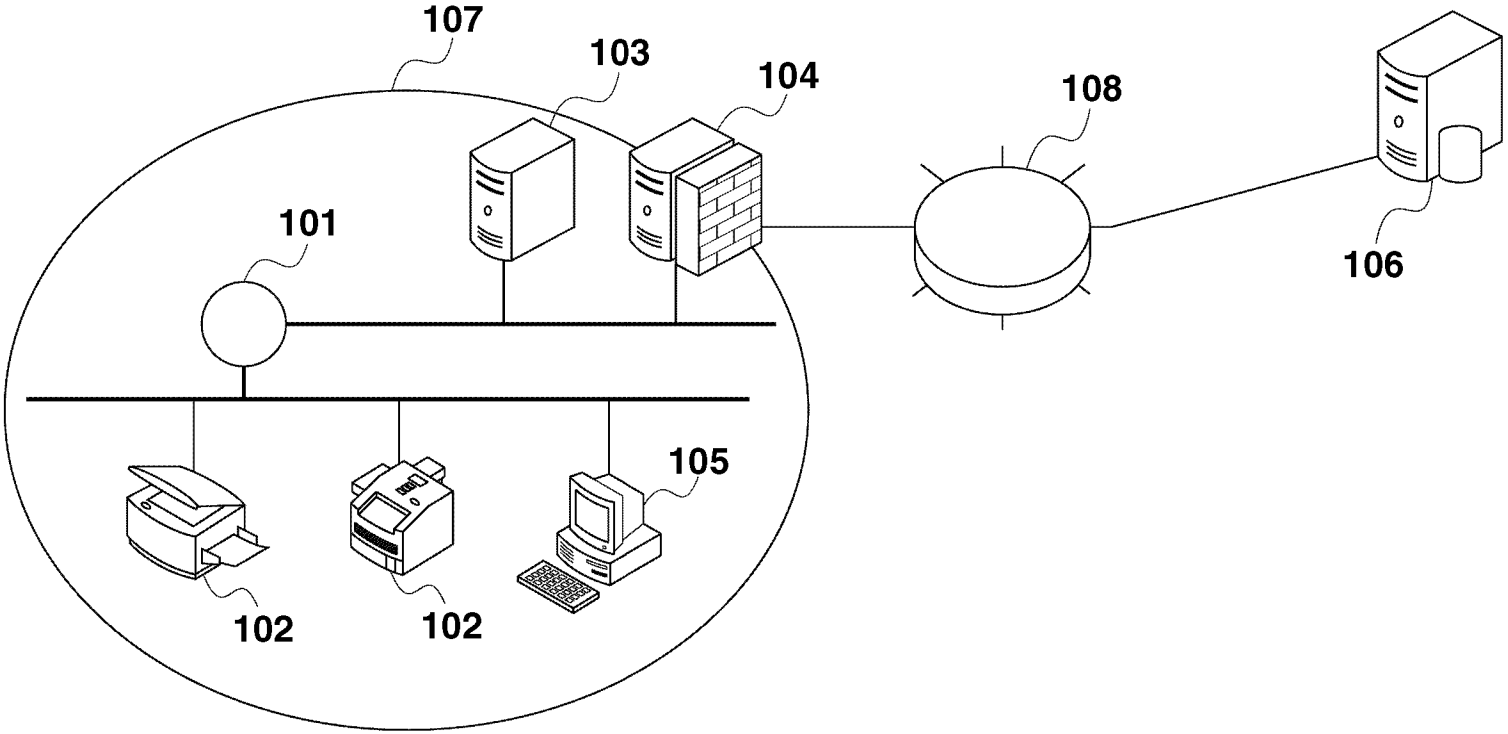
FIG. 1 illustrates a connection relationship between an image forming apparatus and a management apparatus via the Internet.

FIG. 1 is a diagram illustrating a printing system according to a first exemplary embodiment of the present invention, wherein a connection relationship between an image forming apparatus main body and a management apparatus via the Internet is illustrated.

As illustrated in FIG. 1, the printing system includes a local area network (LAN) 101, image forming apparatuses 102, a proxy server 103, and a firewall (FW) 104 installed for enhancing security of the Internet. The image forming apparatus 102 may include other functions than the printing function, such as scanning, facsimile, and copying functions. A personal computer (PC) 105 is a computer used by a general user for work and the like, and the apparatuses are connected to the LAN 101, and an environment 107 in which the apparatuses connected to the LAN 101 are connected to the Internet via the FW 104.

Here, a management apparatus 106 integrally manages operation state of the image forming apparatus. Each of the image forming apparatuses 102 sends operation information (counter value such as the number of sheets to be printed, operation state log, installation environment information, and technical hitch information) to the management apparatus 106 via the Internet 108 according to a communication schedule that is set therein via the LAN 101. Examples of a method for the communication include communication by Management Information Base (MIB) via Simple Network Management Protocol (SNMP) and the like. Here, protocols such as HyperText Transfer Protocol (HTTP) and Hypertext Transfer Protocol over Secure Socket Layer (HTTPS) are assumed as the communication protocol between the apparatuses without particular limitation thereto. For example, in the example of FIG. 1, the image forming apparatus 102 sends data to the management apparatus 106 via the proxy server 103 and the FW 104 by utilizing HTTPS. Also, the management apparatus 106 can set a plurality of customer networks in each of which an image forming apparatus is installed, such as the environment 107, as the object for management via the Internet.

Figure 2:
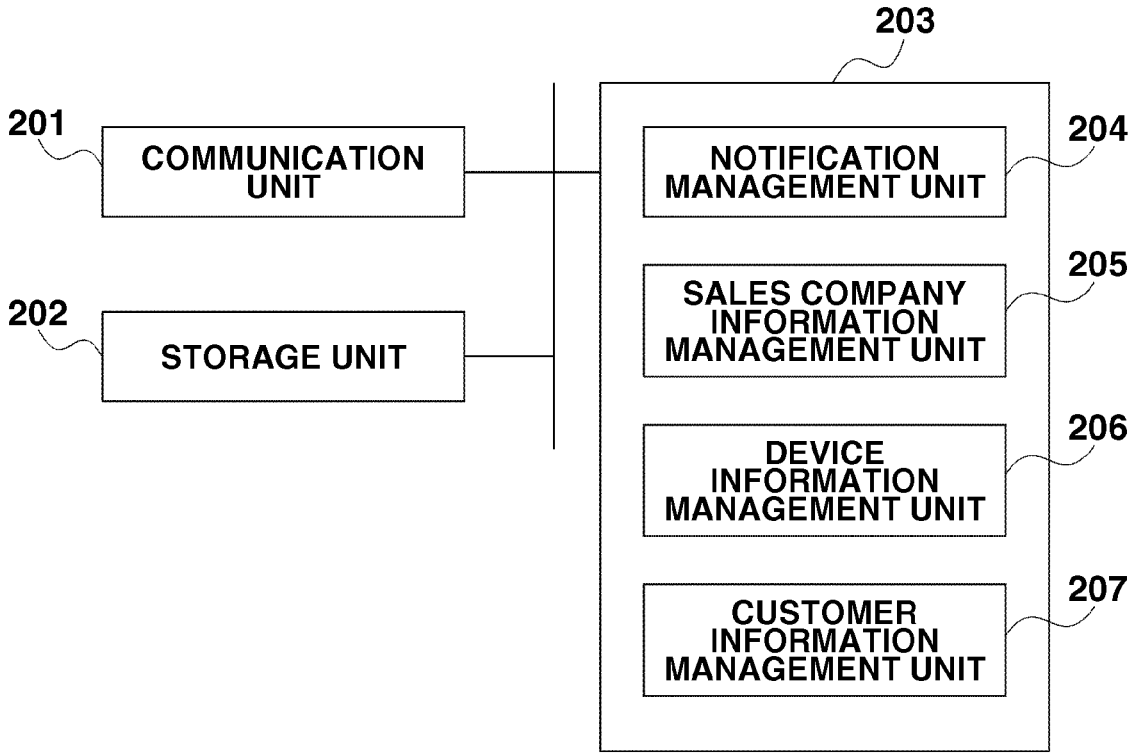
FIG. 2 is a block diagram illustrating the management apparatus.

FIG. 2 is a diagram illustrating a hardware configuration of the management apparatus 106 and function modules to be realized by the management apparatus 106. The management apparatus 106 includes a communication unit 201, a storage unit 202, and a control unit (CPU) 203.

The communication unit 201 has a function of performing communication with the image forming apparatus 102. More specifically, the communication unit 201 controls receipt of device information (various identification information and operation information of an image forming apparatus) sent from the image forming apparatus 102 and sending of instructions and various information to the image forming apparatus 102.

The storage unit 202 stores device information, sales company information, customer information, and the like.

The management unit 203 realizes function modules such as a notification management unit 204, a sales company information management unit 205, a device information management unit 206, and a customer information management unit 207. By way of the function modules realized by the management unit 203, a plurality of image forming apparatuses are monitored, and information required for performing maintenance, for example, is managed. The notification management unit 204 generates notification information to be notified via the communication unit 201 and designates a destination. Examples of the notification include a maintenance request notification and a consumable supply request notification to a service person who performs maintenance work of the image forming apparatus 102 and the like. The sales company information management unit 205 manages information of sales companies performing management and support of the image forming apparatuses 102 installed in the customer network. The device information management unit 206 manages information about the image forming apparatuses 102 which are the object of maintenance. Examples of the information as the object for management include identification information for identifying each of the image forming apparatuses (device ID, device type, IP/MAC address, etc.), operation information and maintenance history of the image forming apparatus, administrator information about a person who manages the image forming apparatus, consumable information of the image forming apparatus, and the like. The customer information management unit 207 manages information about customers in the customer network in which the image forming apparatuses 102 are installed. Among the information, information about maintenance contracts with the sales companies is included.

Figure 3:
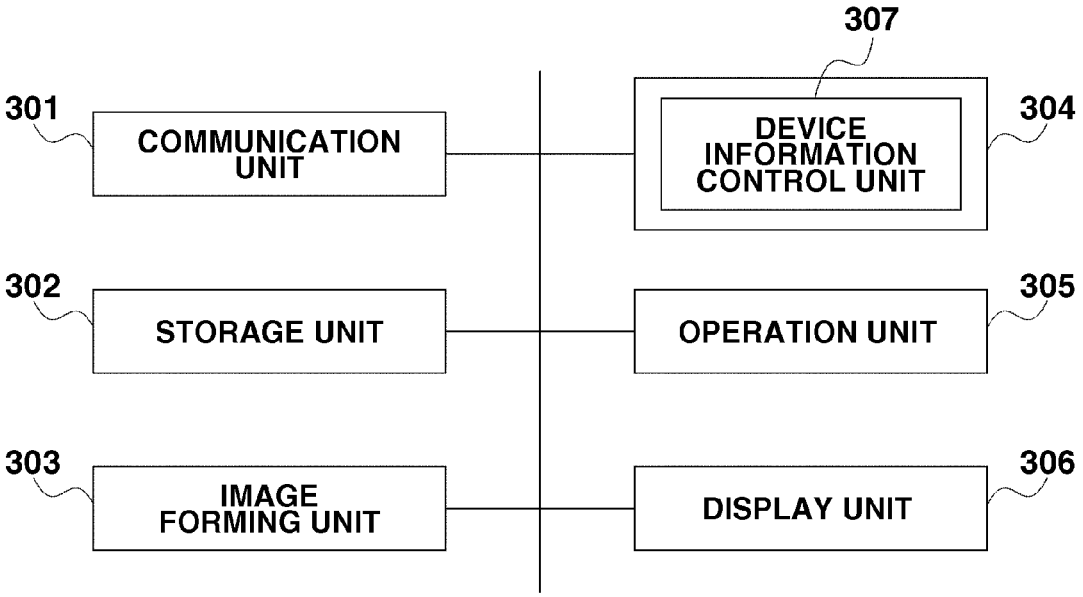
FIG. 3 is a block diagram illustrating the image forming apparatus.

FIG. 3 illustrates a hardware configuration of the image forming apparatus 102 and function modules realized by the image forming apparatus. The image forming apparatus includes a communication unit 301, a storage unit 302, an image forming unit 303, a management unit 304, an operation unit 305, and a display unit 306.

The communication unit 301 manages sending of device information about the image forming apparatus 102 to the management apparatus 106, an instruction sent from the management apparatus 106, and receipt of various information. The sending and receiving are realized by utilizing Simple Mail Transfer Protocol (SMTP), HTTP/HTTPS, and the like.

The storage unit 302 stores identification information of the image forming apparatus, identification information of the management apparatus, and the like. Also, the storage unit 302 stores various counter values, operation history, and operation information such as information indicating various abnormal states of the image forming apparatus 102. The management apparatus information includes the information about communication, such as an Internet Protocol (IP) address of the management apparatus 106 that manages the image forming apparatus 102.

The image forming unit 303 has a function of generating print data and performing print output.

The control unit 304 realizes the device information control unit 307 that is a function module for controlling the overall image forming apparatus 102, controlling various information contained in the device information, and controlling sending according to the schedule. The device information control unit 307 performs detection and management of abnormality in print control and other states of the image forming apparatus and manages counter values and notification information to external apparatuses. Also, the device information control unit 307 controls settings for color adjustment, print mode, and other functions according to input instructions.

The operation unit 305 is an interface that enables operation on the image forming apparatus 102 including the print instruction from a user. The display unit 306 displays screens each containing information that is appropriate for the user. The displayed information includes status information, various setting information, and the like of the image forming apparatus.

FIG. 4 illustrates an example of a table for managing information about components used in the image forming apparatuses, which is stored in the management apparatus 106. The table is stored in the storage unit 202 of the management apparatus 106.

In the table of FIG. 4, there are a component name 401 of each of the components, a serial number 402 for identifying each of the components, and a unit 403 of the counter value used for calculating a consumption ratio of each of the components. The unit is the number of sheets in the present exemplary embodiment, and other examples of the unit include a rotation number and a use time. There are also a value of the counter 404 of each of the components, the consumption ratio 405 of each of the components, and a date of previous replacement of the component 406. The consumption ratio is calculated from life information of each of the components preliminarily registered in the management apparatus 106 and the value of the counter 404 of each of the components.

FIG. 5 illustrates an example of a table for managing the customer information registered in the management apparatus 106. The table is stored in the storage unit 202 of the management apparatus 106.

As the customer information, for example, information such as a customer name, a customer ID, a contract start date, a contract termination date, a remaining contract term is managed. The item "reuse contract 501" indicates the presence or absence of a reuse contract, which enables indicating whether it is allowed to use a reuse consumable for consumable replacement in the contract. If the reuse contract is YES, it means that it is possible to use a reuse component in addition to a new component for component replacement.

FIG. 6 illustrates an example of a table for managing the information about reuse components, which is stored in the management apparatus 106. The table is stored in the storage unit 202 of the management apparatus 106.

In the table in FIG. 6, there are a component name 601 of each of the reuse components, a serial number 602 for identifying each of the reuse components, and a unit of a counter 603 used for calculating a consumption ratio of each of the components. The unit is the number of sheets in the present exemplary embodiment, and other examples of the unit include a rotation number and a use time. There are also a value of the counter 604 of each of the components, the consumption ratio 605 of each of the components, and a date 606 of collection of each of the reuse components. Each of the reuse components has been collected as a reusable component from an image forming apparatus that cannot be repaired due to breakdown in the customer environment or has been disposed due to other reasons and processed when so required.

FIG. 7 illustrates an example of a table for managing information about association between the reuse consumables, which is stored in the management apparatus 106, and serving as objects for replacement and settings of the image forming apparatus to be changed in the case of the replacement. The table is stored in the storage unit 202 of the management apparatus 106. Denoted by 701 is a name (component name, etc.) of each of the reuse consumables. Denoted by 702 is a setting of the image forming apparatus to be changed in the case of replacement with a reuse component. Here, a photosensitive drum, a conveyance roller, a back side of printed paper, and the like are managed as the reuse consumables, for example, and calibration is performed when the reuse photosensitive drum, for example, is replaced. The back side of printed paper means a sheet of paper having one side already printed.

As to the setting to be changed according to the reuse component such as the conveyance roller, the setting value to be changed is changed according to a degree of consumption of the reuse component.

Figure 8:
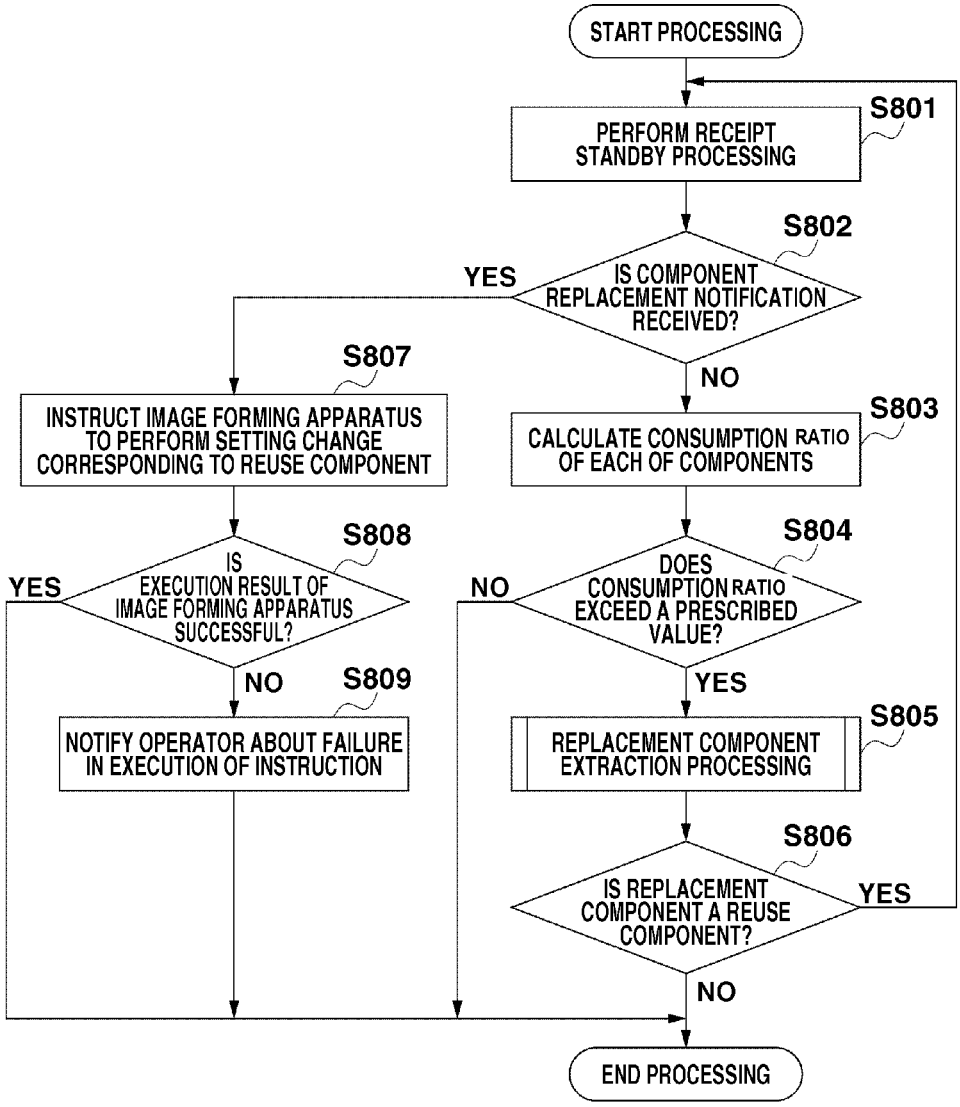
FIG. 8 is a flowchart illustrating processing by the management apparatus for extracting a replacement component and instructing the image forming apparatus about settings.

FIG. 8 is a flowchart illustrating an example of processing by the management apparatus 106 from extraction of a consumable to be used for replacement to an instruction to the image forming apparatus 102 for a setting change. The respective steps of the processing by the management apparatus in the flowchart is realized by the control unit 203 reading a program stored in the storage unit 202.

In step S801, the device information management unit 206 is in a standby state until receiving information from the image forming apparatus 102, and the processing proceeds to step S802 upon the reception. Here, as the information to be received from the image forming apparatus, the device information and the component replacement notification are described. In step S802, the device information management unit 206 determines whether the information received from the image forming apparatus 102 is the component replacement notification. Here, the processing proceeds to step S807 when the information is the component replacement notification. In the case of receiving the device information, the processing proceeds to step S803.

In step S803, when the device information includes the counter values of consumables (component, etc.) used in the image forming apparatus 102, the device information management unit 206 calculates the consumption ratio of each of the components based on the information. In step S804, the device information management unit 206 determines whether the consumption ratio of the component calculated in step S803 exceeds a prescribed value. Here, the prescribed value means a value that has preliminarily been registered in the management apparatus 106 and can be changed by a person who manages the management apparatus 106 based on information provided by a vender who produces and manages the component. Though the prescribed value is described as the one preliminarily registered in the management apparatus 106 in the present exemplary embodiment, the prescribed value may be registered in the image forming apparatus 102. When the consumption ratio of each of the components used in the image forming apparatus 102 does not exceed the prescribed value as a result of the determination in step S804, the processing in the management apparatus 106 is terminated. When any of the consumption ratios of the components used in the image forming apparatus 102 exceeds the prescribed value, the processing proceeds to step S805. In step S805, extraction processing of a replacement component for the component of which the consumption ratio exceeds the prescribed value is performed. The replacement component extraction processing will be described in detail using the flowchart of FIG. 9.

In step S806, the device information management unit 206 determines whether the extracted replacement component is a reuse component. When the extracted replacement component is not the reuse component as a result of the determination in step S806, the processing in the management apparatus 106 is terminated. When the extracted replacement component is the reuse component as a result of the determination in step S806, the processing returns to step S801, and the device information management unit 206 is in the standby state to wait for the component replacement notification from the image forming apparatus 102. The component replacement notification is notified from one of the image forming apparatuses when a service person arranged for maintenance work of the image forming apparatus or a user replaces a component.

In step S807, based on the received replacement component notification, the device information management unit 206 sends an instruction for a setting change corresponding to the reuse component that has been extracted in the processing of step S805 and has been actually replaced to the image forming apparatus 102. Contents of the setting change are determined by referring to the table illustrated in FIG. 7, and a notification including the instruction is generated by the notification management unit 204.

In step S808, the device information management unit 206 confirms whether execution of the contents of the instruction has been successful in the image forming apparatus 102 corresponding to the setting change execution instruction performed in step S807. The confirmation is performed by way of confirmation by receiving a notification of a success or a failure from the image forming apparatus 102 or confirmation by processing for determining a failure if a success notification is not received during a predetermined period of time. When the execution result of the image forming apparatus 102 is not successful as a result of the confirmation in step S808, the device information management unit 206 notifies in step S809 the person who manages the management apparatus 106 about the failure. If the execution result of the image forming apparatus 102 is successful as a result of the confirmation in step S808, the processing is terminated. If the setting change results in failure, it is possible to notify a person who is in charge of management belonging to the customer network about the failure of the automatic setting change and to recommend a manual setting change.

Figure 9:
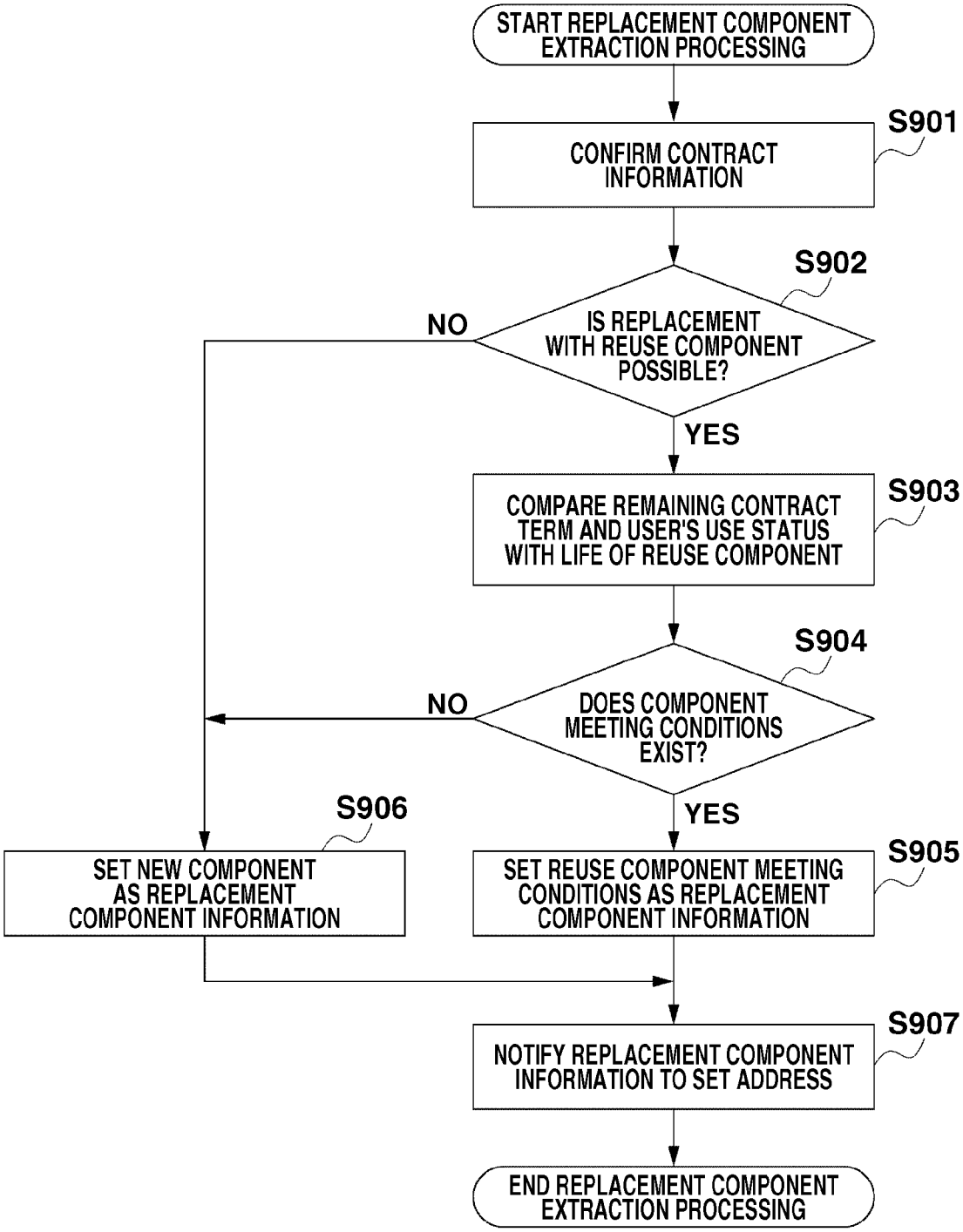
FIG. 9 is a flowchart illustrating the replacement component extraction processing by the management apparatus.

FIG. 9 is a flowchart illustrating details of the replacement component extraction processing in step S805 by the management apparatus 106.

In step S901, the device information management unit 206 confirms the reuse contract 501 of the customer information table stored in the storage unit 202. In step S902, the device information management unit 206 refers to the reuse contract 501 to determine whether the contract allows replacement with a reuse component. As a result of the determination in step S902, the processing proceeds to step S907 if the replacement with reuse component is impossible, while the processing proceeds to step S903 if the replacement with reuse component is possible.

In step S903, the device information management unit 206 compares a remaining contract term and a use status of the user with a life of the reuse component. In the comparison, a consumption amount of the component to be used in the remaining contract term and a life of the managed reuse component are compared with each other in view of the user's use status. In step S904, it is confirmed whether a reuse component having a satisfactory life exists in view of the use by the user in the remaining contract term as a result of the comparison in step S903. As a result of the confirmation, the processing proceeds to step S907 if there is not any reuse component that satisfies the conditions, while the processing proceeds to step S905 if there is the reuse component that satisfies the conditions. Here, when a reuse component having a short life is selected, more-than-necessary replacement is performed and an increase in cost for the unnecessary replacement and generation of downtime of the image forming apparatus are caused. Therefore, in the present exemplary embodiment, one or more reuse component/components satisfying the conditions meeting the remaining contract term is/are selected.

In step S905, the device information management unit 206 sets as replacement component information the determination that the object of the replacement is the reuse component found in step S904 and meeting the conditions. If there is a plurality of reuse components that meet the conditions as illustrated in FIG. 6, the one having a shorter life may preferentially be selected. With such selection, use of the reuse components is promoted in many apparatuses. In step S906, the device information management unit 206 sets as the replacement component information the determination that the replacement object is a new component.

In step S907, the device information management unit 206 sends a notification including the replacement component information set in step S905 or S906 to a preliminarily set address. The notification is generated by the notification management unit 204.

Figure 10:
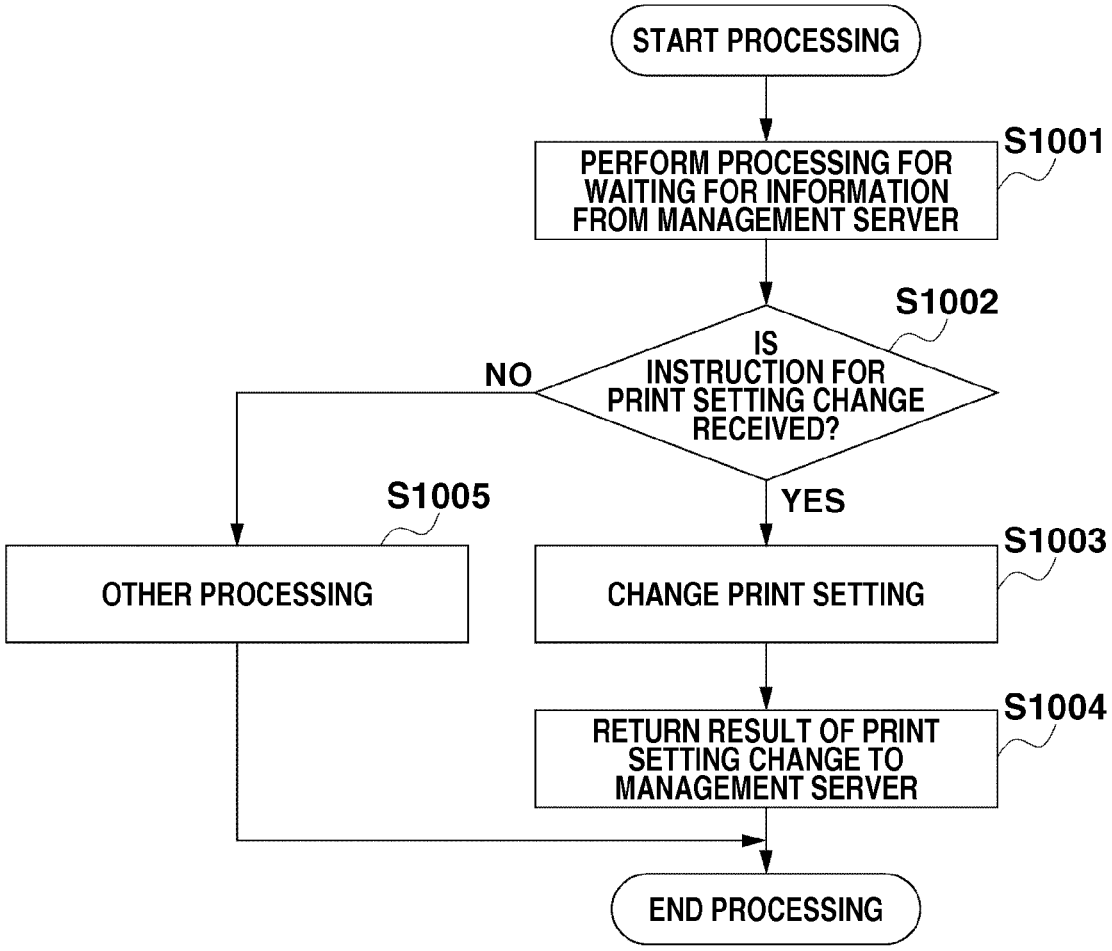
FIG. 10 is a flowchart illustrating in detail processing by the image forming apparatus based on the instruction of the management apparatus.

FIG. 10 is a flowchart illustrating in detail processing by the image forming apparatus 102 based on the instruction from the management apparatus 106. In the present processing, each of steps is executed mainly by the device information control unit 304 of the image forming apparatus 102.

In step S1001, an instruction from the management apparatus 106 is awaited. In step S1002, it is confirmed whether the instruction from the management apparatus 106 is an instruction for changing settings of printing and the like. When the instruction from the management apparatus 106 is not the instruction for setting change as a result of the confirmation in step S1002, the image forming apparatus 102 in step S1005 performs other processing according to the received information. Detailed description of the other processing will not be described in this specification. When the instruction from the management apparatus 106 is the instruction for changing the setting of printing and the like as a result of the confirmation in step S1002, the image forming apparatus 102 in step S1003 changes the setting according to the instruction after the replacement. In step S1004, the image forming apparatus 102 sends a result of the setting change as a reply to the management apparatus 106.

In a second exemplary embodiment of the present invention, processing will be described in detail in which the image forming apparatus 102 changes settings of itself after consumable replacement when replacement with a reuse consumable is performed.

Figure 11:
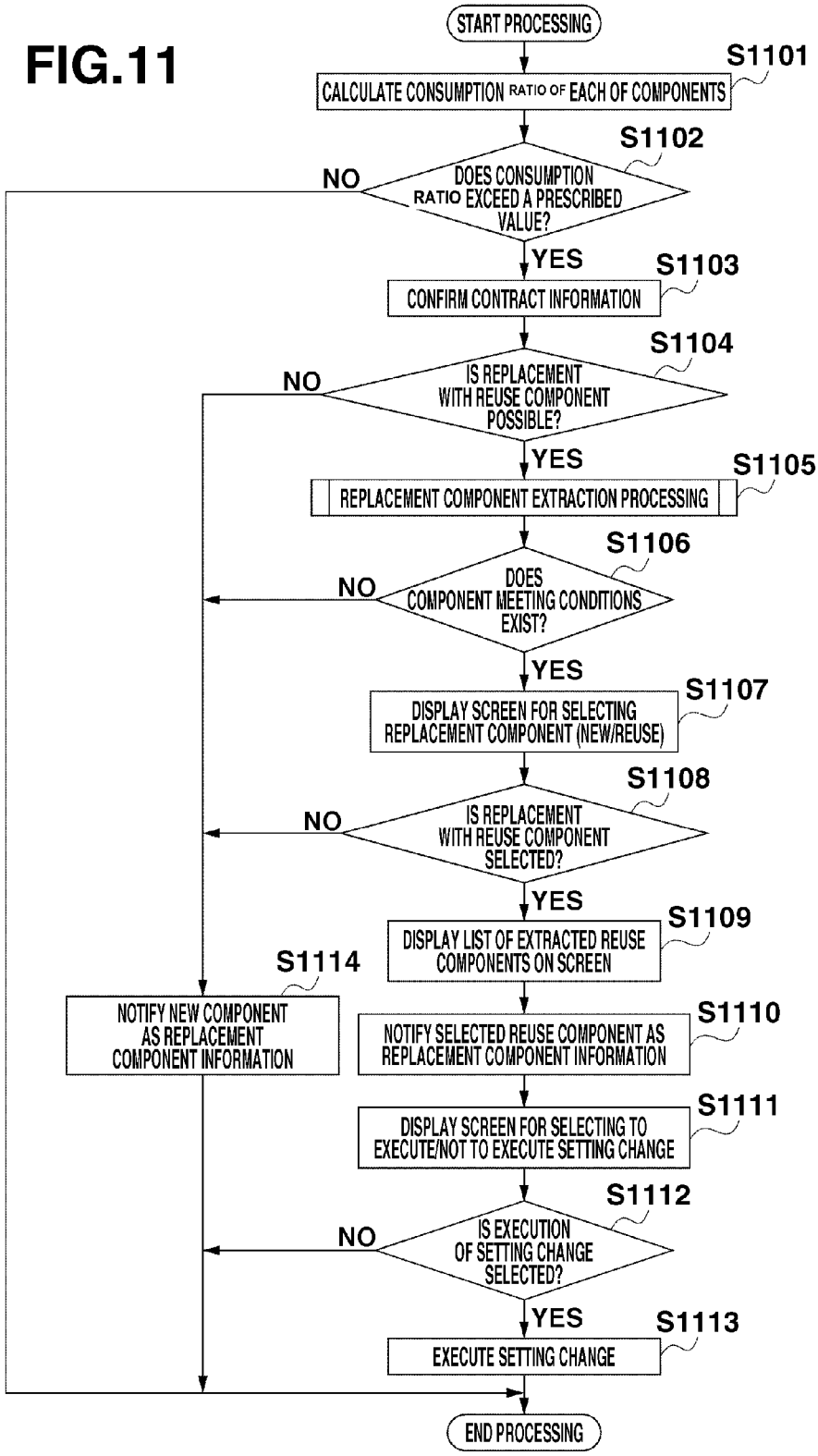
FIG. 11 is a flowchart illustrating processing by the image forming apparatus from the replacement component extraction to the setting change instruction.

FIG. 11 is a flowchart illustrating a processing from a replacement component extraction to a setting change instruction in the image forming apparatus 102. In the present processing, the device information control unit 304 of the image forming apparatus 102 mainly performs each of the steps.

In step S1101, a consumption ratio of each of components is calculated from counter information retained by the image forming apparatus 102 itself. In step S1102, it is confirmed whether the calculated consumption ratio of each of the components exceeds a prescribed value. The prescribed value means a value that has preliminarily been registered in the storage unit 302 of the image forming apparatus 102, which is a recommended value of the vender, and can arbitrarily be changed by a person who is in charge of management. Alternatively, the prescribed value registered in the management apparatus 106 may be obtained via the network or the like. If the consumption ratio of each of the components does not exceed the prescribed value as a result of the confirmation in step S1102, the processing is terminated. If the consumption ratio of the component exceeds the prescribed value as a result of the confirmation in step S1102, the processing proceeds to step S1103.

In step S1103, the customer information table stored in the storage unit 302 is confirmed. The customer information may be managed by an external management apparatus, so that the customer information may be confirmed by inquiring at a timing of the present processing. In step S1104, the image forming apparatus 102 refers to the reuse contract 501 of the customer information to determine whether replacement with a reuse component is possible. The processing proceeds to step S1114 when the replacement with reuse component is impossible as a result of the determination in step S1104, while the processing proceeds to step S1105 when the replacement with reuse component is possible.

In step S1105, the image forming apparatus 102 performs processing for extracting a replacement component. Details of the replacement component extraction processing will be described by using the flowchart of FIG. 12.

In step S1106, the device information control unit 304 determines whether the reuse component meeting the replacement conditions exists in the managed stock. For example, the determination processing is realized by managing the table described by using FIG. 6 in the image forming apparatus. The processing proceeds to step S1114 if the reuse component meeting the replacement conations does not exist as a result of the determination in step S1106, while the processing proceeds to step S1107 if the reuse component meeting the replacement conditions exists.

In step S1107, a screen illustrated in FIG. 13A for a user to select a new component or reuse component as the replacement part is illustrated on the display unit 306. In step S1108, the image forming apparatus 102 confirms which one of "new component replacement" and "reuse component replacement" is selected by the user. The processing proceeds to step S1114 when "new component replacement" is selected by the user as a result of the confirmation in step S1108, while the processing proceeds to step S1109 when "reuse component replacement" is selected.

In step S1109, the reuse component extracted by the extraction processing in step S105 is displayed on the display unit 306 (FIG. 13B). Here, the screen is displayed as a screen for causing the user to select a desired reuse component. In step S1110, the image forming apparatus 102 notifies the determination that a replacement object is the reuse component selected by the user as notification information to a predetermined address via the screen displayed in step S1109. Examples of the predetermined address include a personal computer (PC) of a person who is in charge of management of the stock of consumables, a service company transporting consumables, and the like.

In step S1111, the image forming apparatus 102 inquires the user about whether a setting change corresponding to the reuse component selected via the screen displayed in step S1109 is to be executed by displaying a screen illustrated in FIG. 13C on the display unit 306. Here, contents of the setting change are determined by referring to the table of FIG. 7 as described above. The table is stored in the storage unit 302 of the image forming apparatus 102, for example, in the present exemplary embodiment. In step S1112, it is confirmed whether "execution of setting change" is selected by the user. The processing proceeds to step S1113 when "execution of setting change" is selected by the user as a result of the confirmation in step S1112, while the processing is terminated when "execution of setting change" is not selected. In step S1113, the setting of the image forming apparatus 102 itself is changed. Here, the execution of setting change is assumed to be performed after the replacement of the reuse component by a service person or the person who is in charge of management. If the execution of setting change is performed before the replacement of reuse component, the setting change is reserved and registered to be executed upon detection of the replacement.

In step S1114, notification information of the determination that the replacement object is a new component is notified to the predetermined address.

In the present exemplary embodiment, the setting change of the reuse component has been described. As a specific example, in the case of using a back side of printed paper, not a new paper, as the reuse component to be supplied in the case of paper out in a cassette, setting for restricting (inhibiting) two-sided printing is performed as the setting change to be executed in step S1113. In such case, the replacement with the reuse component and the setting change are recommended to the user by displaying on the display unit 306 a screen illustrated in FIG. 14A in step S1107 or a screen illustrated in FIG. 14B in step S1111. Here, "setting for restricting (inhibiting) two-sided printing" performed for the image forming apparatus means processing for automatically changing to one-sided printing when a print instruction including two-sided printing is received in the image forming apparatus. In addition, processing for interrupting printing when a print instruction including two-sided printing is given and notifying the user who has given the print instruction about the cassette number and the inhibition of two-sided printing when the cassette is designated.

The back side of printed paper means a sheet of paper having one side already printed, which can be reused as a part of effort for resource saving.

Figure 12:
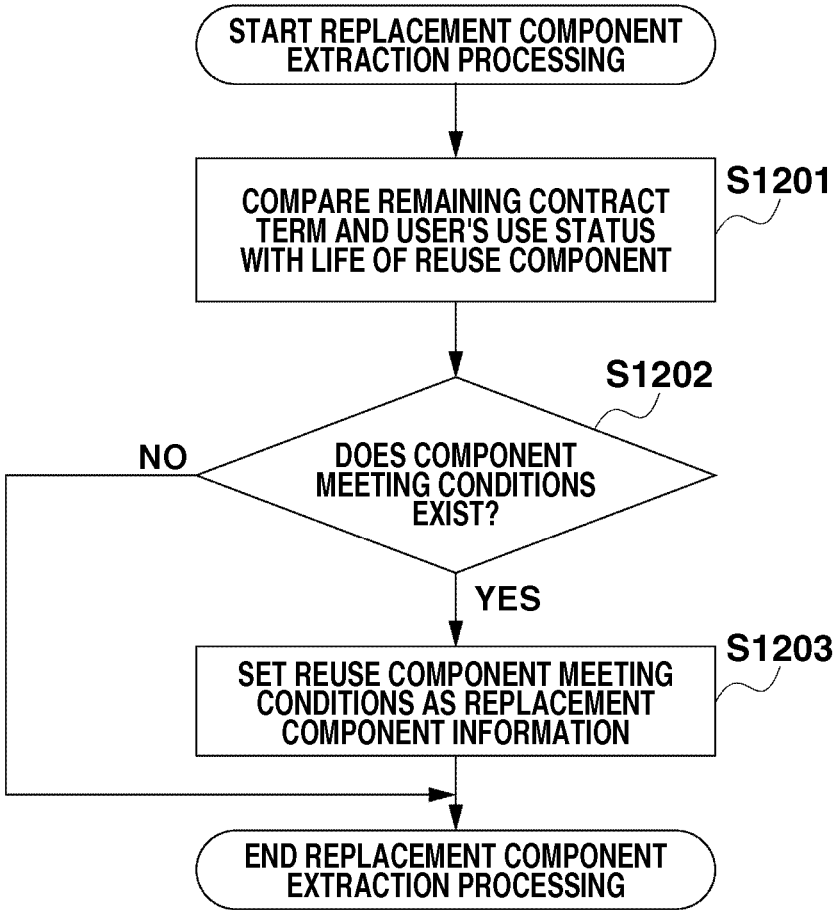
FIG. 12 is a flowchart illustrating details of the replacement component extraction processing by the image forming apparatus.

FIG. 12 is a flowchart illustrating the details of the replacement component extraction processing in step S1105 by the image forming apparatus 102.

In step S1202, a remaining contract term and a use status by the user of the image forming apparatus 102 are compared with a life of the reuse component. The comparison is the same of that of step S903 described above.

In step S1202, as a result of the comparison in step S1201, it is confirmed whether the reuse component having the satisfactory life when used by the user during the remaining contract term exists. The processing is terminated if the reuse component meeting the conditions does not exist as a result of the confirmation in step S1202. When the reuse component meeting the conditions exists as a result of the confirmation in step S1202, the determination that the replacement object is the reuse component meeting the conditions is set as the notification information.

Though the calculation of component consumption ratio and the processing for extracting reuse component are performed by the image forming apparatus 102 in the present exemplary embodiment, it is possible to adopt a mode in which the processing is performed by the management apparatus 106, and the image forming apparatus 102 inquires about the result. Also, as to the notification of replacement component information, it is possible to adopt a mode in which the notification from the image forming apparatus 102 to the management apparatus 106 is performed at a time point when the reuse component is selected by the user, and the management apparatus 106 performs the notification to the predetermined address.

In the processing in FIG. 11, the case of using the back side of printed paper, not a new plain paper, as the reuse component in supplying paper in the case of paper run-out in a cassette has been described.

Here, in the operation environment of the printing system, a method for inhibiting a user (role) or a department from performing one-sided printing is provided for causing awareness of resource saving. For example, authorization information for inhibiting one-sided printing and color printing is managed by the image forming apparatus or an external server in association with user information of a user when a print instruction is input by the user. By referring to the authorization information based on the user information in the case of receiving the print instruction, the print instruction by the user is changed to two-sided printing setting or cancelled.

In the present invention, a method for appropriate operation in view of print control for each of the user's authorizations is further provided. More specifically, when the back side of printed paper is set in the case of paper replacement in the present invention, new authorization information is generated. For example, in the case of printing in which the sheet cassette in which the back side of printed paper is set is assigned, authorization information including exceptional setting for exceptionally allowing the user to perform one-sided printing is generated.

By employing the method, it is possible to provide a flexible mechanism for allowing the user for whom one-sided printing is inhibited to perform one-sided printing in the case of printing using the back side of printed paper.

Aspects of the present invention can also be realized by a computer of a system or apparatus (or devices such as a CPU or MPU) that reads out and executes a program recorded on a memory device to perform the functions of the above-described embodiment (s), and by a method, the steps of which are performed by a computer of a system or apparatus by, for example, reading out and executing a program recorded on a memory device to perform the functions of the above-described embodiment(s). For this purpose, the program is provided to the computer for example via a network or from a recording medium of various types serving as the memory device (e.g., computer-readable medium).

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2009-118975 filed May 15, 2009, which is hereby incorporated by reference herein in its entirety.

What is claimed is:

1. A printing system including a management apparatus for managing replacement according to a consumption degree of a consumable of an image forming apparatus using a new consumable or a reuse consumable, the printing system comprising:

a determination unit configured to determine which of the new consumable and the reuse consumable to use in a case of replacing the consumable of the image forming apparatus;

a notification unit configured to notify that the new consumable or the reuse consumable is to be used for the replacement based on a result of the determination by the determination unit; and an instruction unit configured to instruct a setting to be changed according to the replacement with the reuse consumable from the management apparatus to the image forming apparatus if it is determined by the determination unit that the reuse consumable is to be used, wherein the setting to be instructed by the instruction unit includes execution of calibration when the reuse consumable to be used for the replacement is a photosensitive drum, a change in roller rotation number when the reuse consumable to be used for the replacement is a conveyance roller, and restriction of two-sided printing when the reuse consumable to be used for the replacement is the back side of printed paper.

2. The printing system according to claim 1, wherein the determination unit determines which of the new consumable and the reuse consumable to use based on customer information of a user of the image forming apparatus.

3. The printing system according to claim 2, wherein the determination unit determines the reuse consumable to be used for the replacement based on a comparison between a remaining contract term and a use status by the user included in the customer information and a life of the reuse consumable.

4. The printing system according to claim 1, wherein the determination unit determines which of the new consumable and the reuse consumable to use based on an instruction from a user of the image forming apparatus.

5. The printing system according to claim 1, wherein the instruction unit changes a setting value to be set in the image forming apparatus according to the consumption degree of the reuse consumable to be used for the replacement.

6. A method for a printing system including a management apparatus for managing replacement according to a consumption degree of a consumable of an image forming apparatus using a new consumable or a reuse consumable, the method comprising:

determining which of the new consumable and the reuse consumable to use in a case of replacing the consumable of the image forming apparatus;

notifying that the new consumable or the reuse consumable is to be used for the replacement based on a result of the determination; and instructing a setting to be changed according to the replacement with the reuse consumable from the management apparatus to the image forming apparatus if it is determined that the reuse consumable is to be used, wherein the instructed setting includes execution of calibration when the reuse consumable to be used for the replacement is a photosensitive drum, a change in roller rotation number when the reuse consumable to be used for the replacement is a conveyance roller, and restriction of two-sided printing when the reuse consumable to be used for the replacement is the back side of printed paper.

* * * * *